US009013104B1

(12) United States Patent
Ferguson et al.

(10) Patent No.: US 9,013,104 B1
(45) Date of Patent: Apr. 21, 2015

(54) PERIODIC PERMANENT MAGNET FOCUSED KLYSTRON

(71) Applicants: Patrick Ferguson, Oakland, CA (US); Michael Read, Plainfield, VT (US); R. Lawrence Ives, San Mateo, CA (US)

(72) Inventors: Patrick Ferguson, Oakland, CA (US); Michael Read, Plainfield, VT (US); R. Lawrence Ives, San Mateo, CA (US)

(73) Assignee: Calabazas Creek Research, Inc., San Mateo, CA (US)

( * ) Notice: Subject to any disclaimer, the term of this patent is extended or adjusted under 35 U.S.C. 154(b) by 0 days.

(21) Appl. No.: 14/059,641

(22) Filed: Oct. 22, 2013

Related U.S. Application Data

(60) Provisional application No. 61/814,401, filed on Apr. 22, 2013.

(51) Int. Cl.
*H01J 23/08* (2006.01)
*H01J 25/10* (2006.01)
*H01J 23/087* (2006.01)

(52) U.S. Cl.
CPC ..... *H01J 25/10* (2013.01); *H01J 23/0873* (2013.01)

(58) Field of Classification Search
USPC ..... 315/5.35; 332/133; 331/6, 83
See application file for complete search history.

(56) References Cited

U.S. PATENT DOCUMENTS

| | | | | |
|---|---|---|---|---|
| 4,733,131 | A * | 3/1988 | Tran et al. | 315/5.14 |
| 5,235,249 | A * | 8/1993 | Mourier | 315/5.14 |
| 5,811,943 | A * | 9/1998 | Mishin et al. | 315/505 |
| 5,838,107 | A * | 11/1998 | Beunas et al. | 315/5.16 |
| 6,486,605 | B1 * | 11/2002 | Beunas et al. | 315/5.35 |
| 6,768,265 | B1 * | 7/2004 | Ives et al. | 315/5.16 |
| 8,847,489 | B2 * | 9/2014 | Teryaev et al. | 315/5.39 |
| 2005/0023984 | A1 * | 2/2005 | Vancil et al. | 315/5 |
| 2007/0146084 | A1 * | 6/2007 | Syratchev | 331/83 |

* cited by examiner

*Primary Examiner* — Jason M Crawford
(74) *Attorney, Agent, or Firm* — File-EE-Patents.com; Jay A. Chesavage

(57) ABSTRACT

A periodic permanent magnet (PPM) klystron has beam transport structures and RF cavity structures, each of which has permanent magnets placed substantially equidistant from a beam tunnel formed about the central axis, and which are also outside the extent of a cooling chamber. The RF cavity sections also have permanent magnets which are placed substantially equidistant from the beam tunnel, but which include an RF cavity coupling to the beam tunnel for enhancement of RF carried by an electron beam in the beam tunnel.

20 Claims, 10 Drawing Sheets

RF Cavity Structure

Beam Transport Structure

Beam Transport Structure

RF Cavity Structure

RF Cavity Structure

PPM Stack w/extended pole piece

Axial Magnetic Field

Beam Transport Structure

Beam Transport Structure

RF Cavity Structure

RF Cavity Structure

Beam Transport Structure

Beam Transport Structure

RF Cavity Structure

RF Cavity Structure

PERIODIC PERMANENT MAGNET FOCUSED KLYSTRON

The present invention claims priority to provisional patent application 61/814,401 filed Apr. 22, 2013.

The present invention was developed under the U.S. Department of Energy grant No. DE-SC0004558. The government has certain rights in this invention.

FIELD OF THE INVENTION

The present invention relates to a klystron. In particular, the invention relates to a klystron which uses periodic permanent magnets for beam focusing, with the permanent magnets generating an axial magnetic field which reverses polarity along an axial extent of a beam tunnel.

BACKGROUND OF THE INVENTION

Current medical imaging systems use a klystron to develop X-rays for medical therapeutic use by impinging a high speed electron beam onto a target which generates x-rays, and the x-rays are used for treatment of cancerous tumors. In a clinical use linear accelerator (such as the CLINAC® system manufactured by Varian medical systems), a klystron, linear accelerator, and x-ray target are mounted in a gantry that rotates around a cancer patient receiving radiation therapy, with the X-rays directed into a target tumor with high precision.

A typical medical klystron requires on the order of 50 KW of power, roughly half of which is used to energize a solenoidal coil which generates the main axial magnetic field. The resulting overall size and power consumption of the main axial field components results in a system which requires special siting considerations.

For large accelerator systems, elimination of the solenoid and the associated power supply and cooling circuitry also impacts the operating cost. For large klystrons, the solenoid coil can require 20 kW or more. In addition, water cooling is required to remove power generated by resistive losses in the coils.

While operating costs are important for clinical linear accelerator klystrons, equally important considerations are size and weight. The klystron and associated power supplies and cooling are mounted in the gantry, and are significant contributions to the size and stresses on the structure, and accordingly, the large size requirements of the prior art klystron exclude potential installations due to size considerations. Reliability is also an important consideration. Replacement of the solenoidal coil, and associated power supply and cooling system with permanent magnets removes several potential failure modes.

Compared to prior art traveling wave tubes (TWT), klystrons have greater efficiency (typically two to three times greater than TWT). However, the klystron also has specific requirements that cause difficulty in design and implementation. Whereas a TWT tends to have an electron velocity at the final RF output which varies only slightly from maximum to minimum velocity, the final electron velocity in the output cavity of a klystron has a much greater variance, including the possibility that the electron velocity in the klystron may approach 0, which can cause retrograde electron movement, causing an associated degradation in efficiency. In a helical TWT, no RF cavities are present, and in a coupled-cavity TWT, the sequences of cavities are very uniform and confined to within the PPM magnet structure. Consequently, the circuit structure in a TWT does not impact the geometry of the magnet circuit. In a klystron, the RF cavities along the axis are placed with irregular periodicity according to the resultant beam characteristics, and as a result, the circuit structures and the PPM structures must be integrated, since they overlap each other radially.

Klystrons typically have an efficiency that is two to three times greater than a TWT, and because of this efficiency, as well as the difficulty in cooling the helical wave structure of a TWT, a high power klystron will often operate at a much higher power level than a high power TWT. Consequently, there are requirements for increased cooling of the circuit regions of the klystron, and unlike TWT circuits, direct cooling of the klystron RF circuit is required. Moreover, klystrons use resonant cavities to bunch and extract energy from the electron beam, and precise frequency control of the individual cavities is required. This may be accomplished using mechanical structures to tune the RF cavities to the correct frequencies. This is not required in TWTs, since they do not use resonant structures.

It is desired to provide a klystron with cooling for the RF cavities and access to the RF cavities for frequency tuning structures, and optionally to provide cooling for the beam tunnel structures, if required. It is further desired to provide a klystron for a therapeutic treatment system with reduced size, elimination of the requirement for an electromagnetic axial field generator and associated cooling requirement, and which provides for high power operation.

OBJECTS OF THE INVENTION

A first object of the invention is a klystron formed from alternating beam transport structures and RF cavity structures, the beam transport structures and RF cavity structures forming a beam tunnel about a central axis of the klystron;

the beam transport structures also having pole pieces which generate a magnetic field using cylindrical magnets placed a substantially uniform radial distance about the central axis and located on the pole pieces for distributing the magnetic field into the beam tunnel, the cylindrical magnets placed outside the radial extent of a coolant chamber surrounding the beam tunnel which is centered about the central axis, the coolant chamber for circulation of a coolant;

the RF cavity structures also having cylindrical magnets placed a substantially uniform radial distance about the central axis and located adjacent to a pole piece for distributing the magnetic field into the beam tunnel, the cylindrical magnets placed outside the extent of an RF cavity which is coupled to the beam tunnel, the RF cavity structure also having an optional coolant chamber for circulation of a coolant;

and where the cylindrical magnets of each successive beam transport structure or RF cavity structure have an axial magnetic field magnitude and polarity, and where the cylindrical magnets of each successive adjacent beam transport structure or RF cavity structure have a magnetic field magnitude which is substantially equal to the preceding adjacent structure magnetic field magnitude and a polarity which is opposite that of said preceding adjacent structure magnetic field polarity.

SUMMARY OF THE INVENTION

A periodic permanent magnet (PPM) klystron is formed from a succession of beam transport structures and RF cavity structures which may occur in any order or arrangement, but which have magnetic field generators which reverse polarity for each successive structure.

The beam transport structure comprises an iron pole piece which has a plurality of magnetic field generators such as cylindrical permanent magnets placed on the iron pole piece, the beam transport structure also having a coolant chamber formed about a beam tunnel on the central axis of the klystron, where the coolant chamber is for circulation of a coolant. Magnetic field generators are placed on the pole piece a substantially uniform radial distance from the central axis which is beyond the extent of the coolant chamber and which generate an axial magnetic field with a first magnitude and polarity.

The RF cavity structure comprises an iron pole piece which has a plurality of magnetic field generators such as cylindrical permanent magnets placed on the iron pole piece a substantially uniform radial distance from a central axis of the klystron and which generate an axial magnetic field with a magnitude substantially equal in magnitude with the polarity of the magnetic field opposite that of the magnetic field generated by adjacent beam transport structures or RF structures. The RF cavity structure also includes an RF cavity coupled to the beam tunnel, and optionally has a reduced gap in the beam tunnel region.

A klystron assembly is formed from a succession of beam transport structures and RF cavity structures, where the axial magnetic field generated by each successive beam transport structure or RF cavity structure is opposite the magnetic field generated by a previous beam transport structure or RF cavity structure. The beam transport structures and RF cavity structures thereby provide a periodically reversing axial magnetic field which interacts with an electron beam in the beam tunnel to provide beam transport through the klystron, and also provide a input RF cavity, intervening gain RF cavities, and an output RF cavity, each RF cavity positioned at a positive or negative axial magnetic field maximum.

DETAILED DESCRIPTION OF THE INVENTION

Figure 1A:
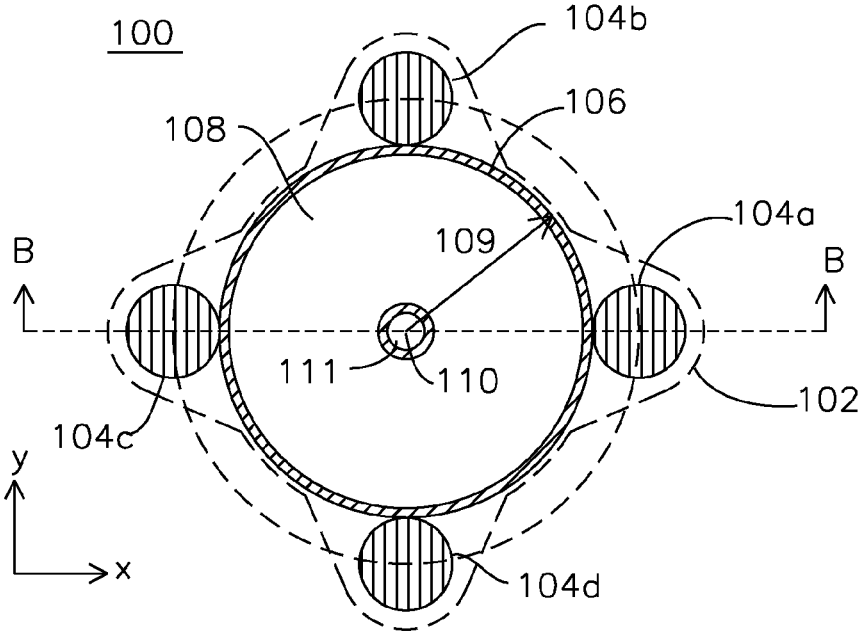
FIGS. 1A and 1B are composite cross section views of a beam transport structure.
Figure 1B:
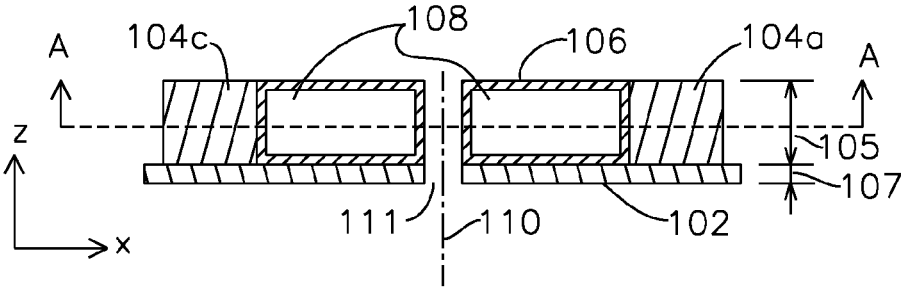

FIGS. 1A and 1B show a beam transport structure 100. FIG. 1A is best understood in combination with FIG. 1B showing section B-B of FIG. 1A, which shows a projected section view A-A of FIG. 1B. The beam transport structure comprises a ferrous pole piece 102 which is adjacent to substantially cylindrical permanent magnets 104*a*, 104*b*, 104*c*, 104*d* positioned in a uniform radial extent about the central z axis 110 and beyond a radial distance 109 from the central axis 110 where a beam tunnel 111 is formed by the inner radius of enclosed coolant chamber 108, which is coupled to liquid coolant (not shown) for circulation to remove heat from the beam transport structure 100. Typically, the cylindrical permanent magnets 104*a*, 104*b*, 104*c*, 104*d* are of identical construction and are positioned a uniform radial distance from the center axis 110 to create a uniform z-axis magnetic field, which reverses polarity with each subsequent structure, as will be described. Cylindrical permanent magnets 104*a*, 104*b*, 104*c*, and 104*d* may be formed from any material with magnetic anisotropy, which provides the property of aligned magnetic field generation, preferably with a high magnetic field strength, such as rare earth materials including samarium-cobalt ($SmCo_5$), neodymium ($Nd_2Fe_{14}B$), Alnico (an alloy of aluminum, Nickel, and Cobalt), or Strontium ferrite ($SrO\text{-}6Fe_2O_3$). The pole piece 102 is fabricated from iron or any alloy which provides coupling of the magnetic field generated by the magnetic field generators 104*a*, 104*b*, 104*c*, and 104*d* to the beam tunnel 111. The thickness of pole piece 102 is selected to prevent magnetic saturation of the pole piece 102 by the magnetic field strength of axial magnetic field generators 104*a*, 104*b*, 104*c* and 104*d*. In one embodiment of the invention, the ratio of the thickness 105 of the magnetic field generator to the thickness 107 of the ferrous pole piece 102 is in the range of 3:1 to 4:1.

Figure 2A:
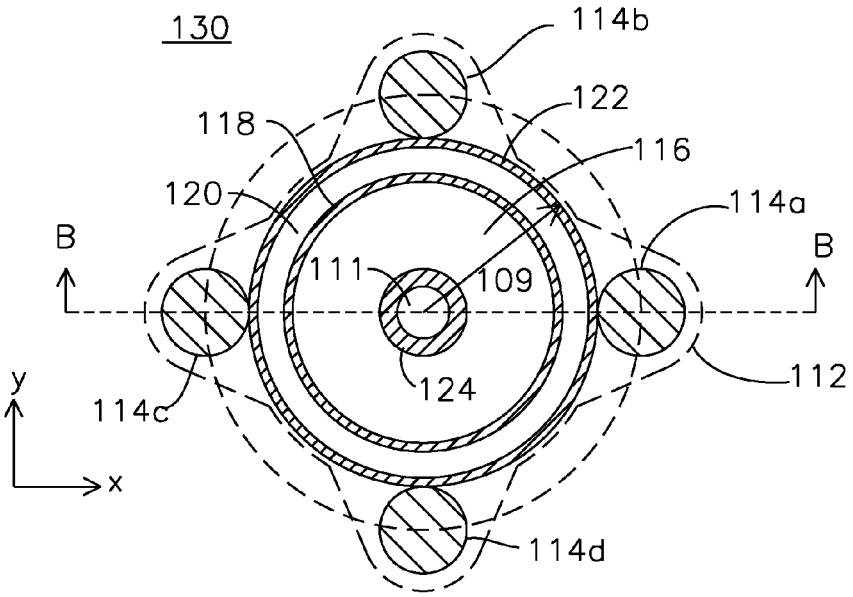
FIGS. 2A and 2B are composite cross section views of an RF cavity structure.
Figure 2B:
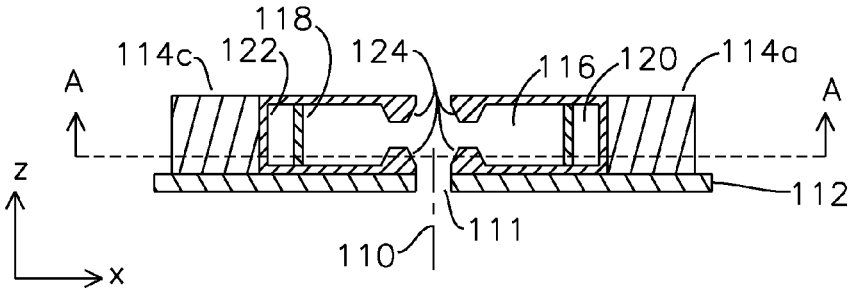

FIGS. 2A and 2B show the RF cavity structure 130, and are similarly best understood in combination with each other, as FIG. 2A shows a projected section view A-A of FIG. 2B, whereas FIG. 2B shows a section view B-B through FIG. 2A. The beam tunnel 111 is formed about central axis 110, as is RF cavity 116, which is adjacent to a coolant chamber 120 for circulation of a coolant which is coupled in and out of coolant chamber 120 through a series of ports (not shown). The RF cavity 116 includes gap reducers 124 which improve the transfer of energy between the cavity electric fields and those of the modulated electron beam by selectively coupling a short axial extent of the modulated electron beam from beam tunnel 110 into the RF cavity 116. Permanent magnets 114*a*, 114*b*, 114*c*, and 114*d* can be cylindrical and positioned with substantially uniform separation radius 109 from the central axis 111, and outside the extent of the coolant chamber 120, which is separated from RF cavity 116 by septum 118. Permanent magnets 114*a*, 114*b*, 114*c*, and 114*d* may be formed from the same materials as were described for magnetic field generators 104*a*, 104*b*, 104*c*, 104*d* of FIGS. 1A and 1B, and the ratio of magnetic field generator thickness to ferrous pole piece 112 along the z axis remains in the range 3:1 to 4:1.

Figure 3:
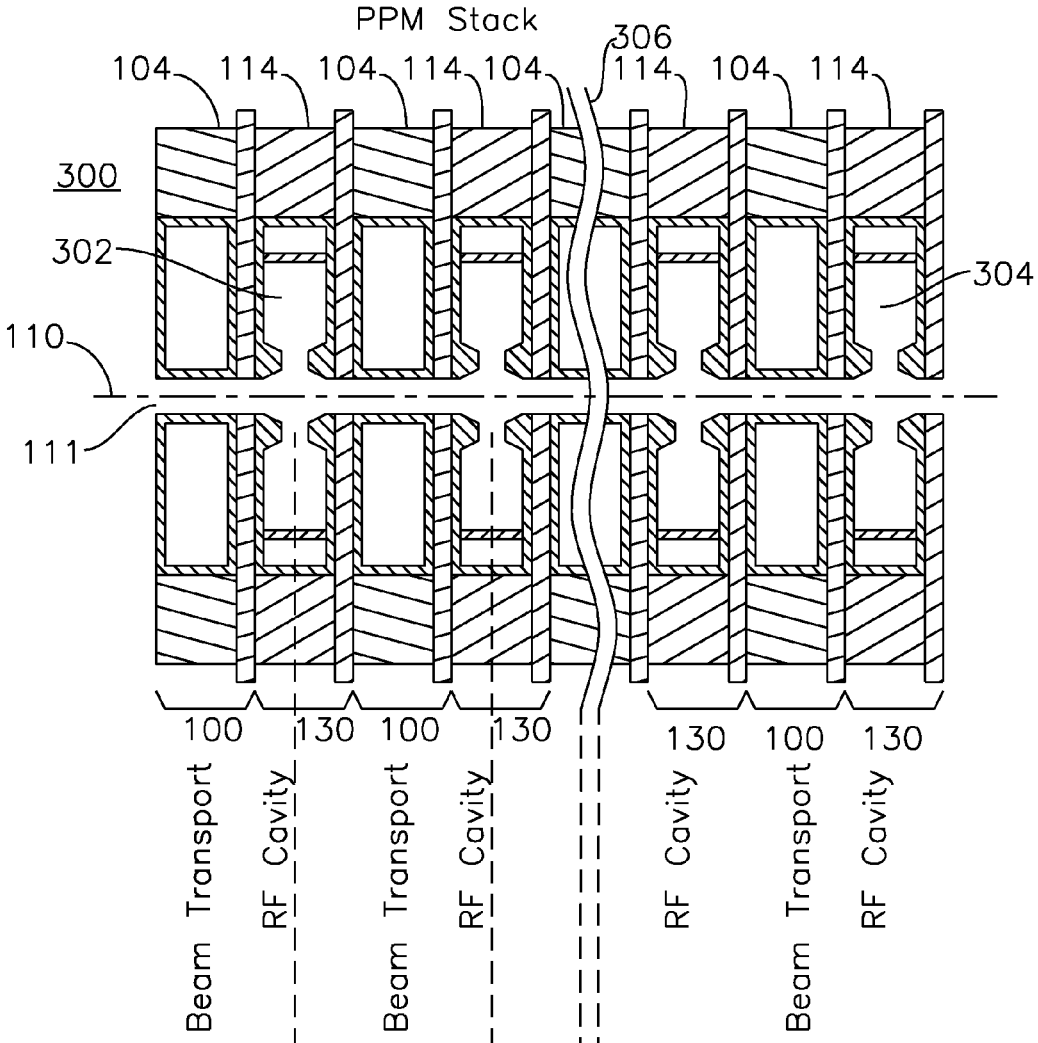
FIG. 3 is a cross section view of a PPM klystron according to an embodiment of the present invention.
Figure 4:
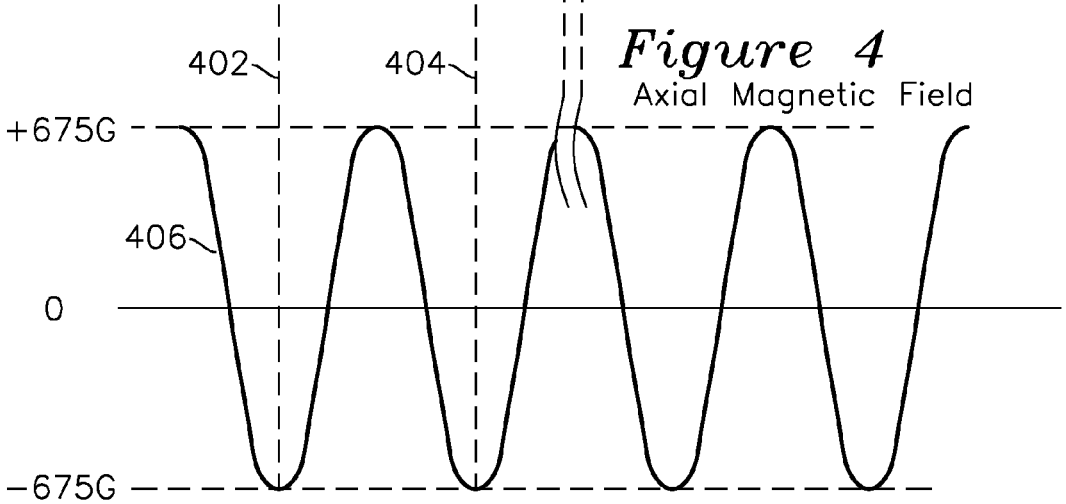
FIG. 4 is a plot of the axial magnetic field of the PPM klystron of FIG. 3.

FIG. 3 shows a klystron which uses the beam transport structures 100 of FIGS. 1A and 1B, and the RF cavity structures of FIGS. 2A and 2B assembled into a PPM stack 300 which forms the beam tunnel and RF circuit elements of the klystron, with an electron gun including a thermionic cathode and anode (not shown) on the left side of axis 110, and a collector (not shown) on the right side of axis 110, where the electron gun may be any prior art generator of an electron beam, and the collector any prior art collector for spent beam dissipation. The PPM stack 300 of FIG. 3 includes an alternating polarity magnetic field generated by the magnetic field generators 104 and 114 of beam transport structure and RF cavity structure, respectively, as was described for FIGS. 1A, 1B, and 2A, 2B, respectively. A typical PPM stack 300 has the first RF cavity 302 coupled to an RF source, with the output power coupled out of final cavity 304. A break in the repeating structures 306 is shown to indicate that any number of such alternating structures may be provided between input RF cavity 302 and output RF cavity 304, and it should be clear that the magnetic field generated by each set of permanent magnets 104 and 114 is substantially uniform in magnitude, but with the magnetic field polarity reversed for each pole piece, generating a reversing magnetic field, as shown in FIG. 4. Other variations of PPM stack of FIG. 3 are possible, including the placement of successive beam transport structures 100 to vary the spacing between RF cavity structures 130, for example, to position the RF cavities of the RF structures 130 in preferred axial locations (rather than the regular and repeating axial locations as shown in FIG. 3).

Figure 5:
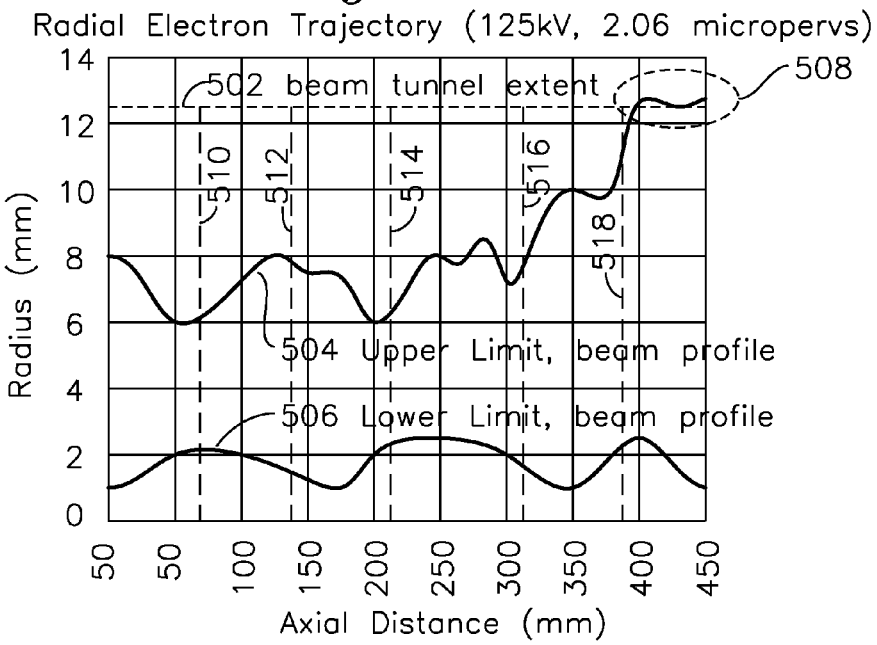
FIG. 5 is a plot of radial extents of the electron beam for the PPM klystron of FIG. 3.

FIG. 5 shows a plot of the theoretical minimum and maximum radial electron trajectory extents for an example klystron according to the present invention, with a peak power of 4.97 MW, a beam voltage of 125 kV, a beam current of 91 A, 5 resonant RF cavities, a gap modulation coefficient of 0.58 (1.5 radians between RF cavities), beam tunnel (also known as drift tube) diameter 24.5 mm, beam filling factor of 0.65, and beam current density of 50 A/cm$^2$. The example design results in an electron beam perveance of 2.06 micropervs, with FIG. 5 indicating the extent 502 of the beam tunnel, and the locations of the five resonant RF cavities indicated as 510, 512, 514, 516, 518. Region 508 indicates electron beam maximum radius has expanded to the point of interception with the radial extent of the tunnel beam, which is undesirable as it would result in shortened life of the electron device.

Figure 6:
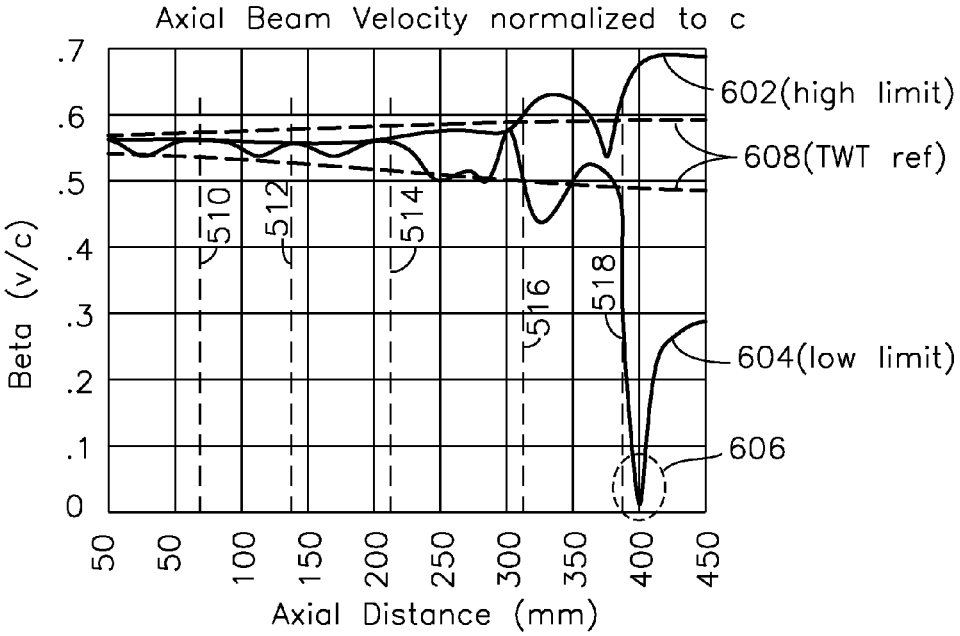
FIG. 6 is a plot of the variation of axial beam velocity for the PPM klystron of FIG. 3.

FIG. 6 is a plot of the klystron axial beam velocity normalized to the speed of light, c, for the 2.06 micropery device of FIG. 5. The high limit 602 of the distribution of beam electrons is shown with the low limit 604 of the distribution, in particular region 606 which indicates that the lowest beam velocity electrons of the beam profile never become negative, which would indicate the generally undesirable case of directing some of the electrons backwards in the final output cavity. Although it is generally not desirable to have retrograde electron velocity in the final output cavity, it is possible for the device to operate under this condition.

As was described earlier, by contrast to the klystron of the present invention, a TWT has much less variation in electron velocity, shown for comparison purposes with the FIG. 6 dashed limit plot lines 608, which illustrates the significantly lower variation in TWT electron beam velocity than the current klystron plots 602 and 604. The greater electron velocity variation of the klystron results in the requirement to address these lower electron velocities, as well as the requirement for inclusion of non-periodic RF structures, in exchange for the higher efficiency and higher power capability provided by the klystron.

Figure 7:
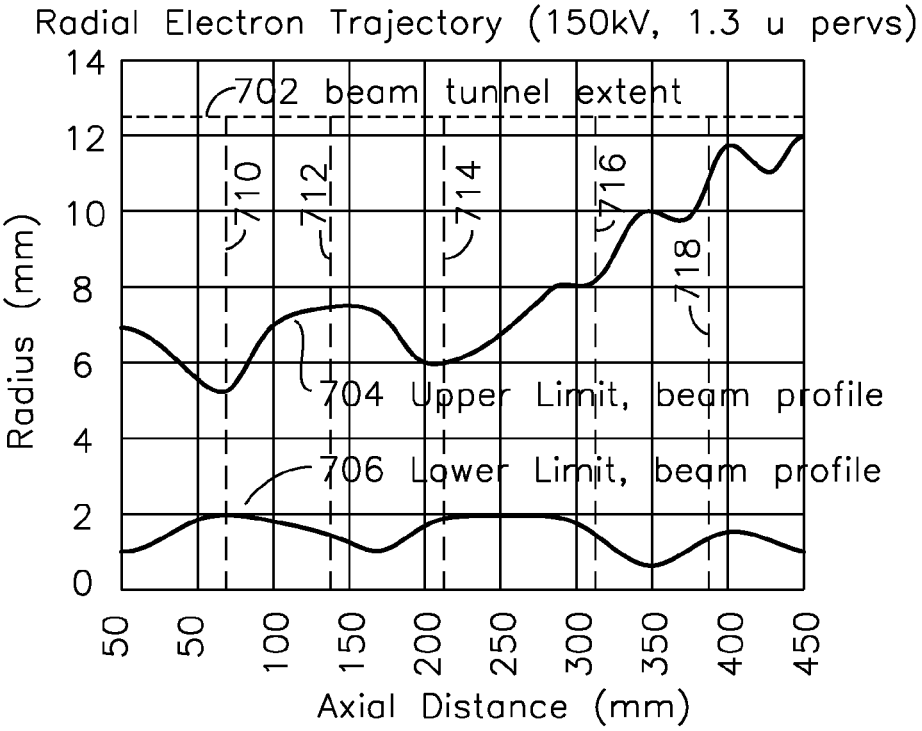
FIG. 7 is a plot of radial extents of the electron beam for the PPM klystron of FIG. 3.

In one example of the invention which eliminates the beam interception shown in region 508, the klystron cathode voltage was increased from 125 kV to 150 kV, reducing the electron beam perveance to 1.3 micropervs, and producing the improved electron trajectory shown in FIG. 7, which no longer exhibits interception from the beam (outer radius 704 with inner radius 706 for reference) to the wall (beam tunnel radial extent 702). The resultant klystron exhibited a peak RF power of 5.58 MW, beam current 75.5 A, efficiency of 49.3%, beam filling factor of 0.6 and a beam current density of 41 A/cm2, with the beam tunnel diameter unchanged from 25.4 cm, and with 5 resonant RF cavities. Although the device without beam interception has lower efficiency, this is preferred over beam interception.

Figure 8:
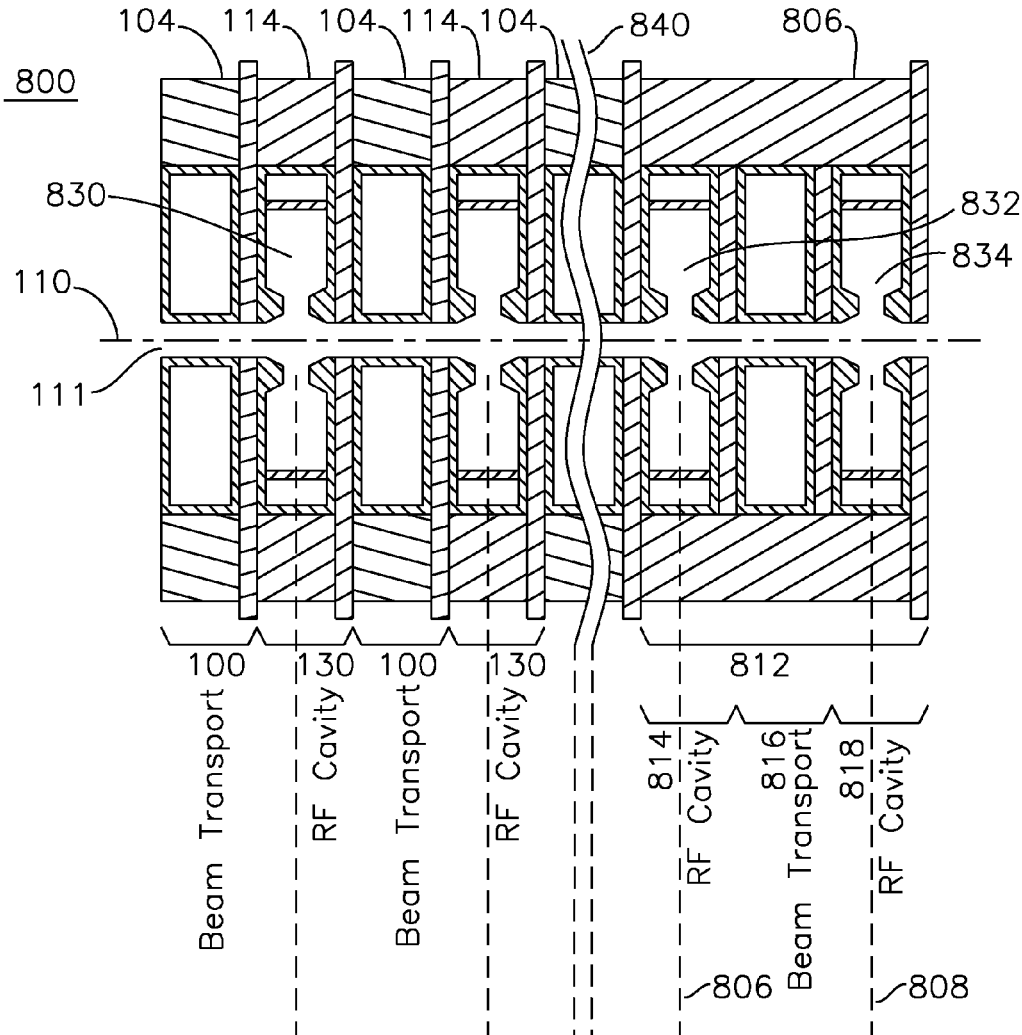
FIG. 8 is a cross section view of a PPM klystron with an extended magnet.

FIG. 8 shows a preferred embodiment of the invention which eliminates the beam interception shown in FIG. 5 region 508 for the PPM stack of FIG. 3 without increasing the cathode voltage which generated the FIG. 7 interception-free plot of electron trajectory. The PPM focused klystron components of FIG. 8 include the input RF cavity 830, which is similar to the other RF cavities, but which is coupled to an input RF source, center axis 110 about which beam tunnel 111 is formed, and the alternating axial magnetic field produced by alternating polarity magnetic field generators 104 and 114, as was described for FIGS. 1A, 1B, 2A, and 2B. The PPM stack of FIG. 8 solves the beam interception problem by extending the final magnetic field generator 806 in region 812 to include multiple RF cavity structures 832 and 834 in corresponding regions 814 and 818 with beam transport section 816 placed between the RF cavities, and with the final RF cavity 834 coupled to the output waveguide. The long extended output structure 812 prevents beam interception by maintaining a constant magnetic field through the region where beam interception is likely to occur, as shown in the axial magnetic field plot of FIG. 9. Reference lines 802, 804, 814, and 808 indicate the relationship between magnetic field and RF cavity gap location, and break 840 indicates that any number of RF cavity structures and beam transport structures may be present between the input RF cavity 830 and output RF cavity 834. It is also understood that the particular spacings, separations, and order of each of the beam transport structures 100 and RF cavity structures 130 may be tailored to the desired characteristics of the device, and the spacing, separation and order of the extended section 812 components of RF cavity structure 814, beam transport structure 816, and output RF cavity 818 may be changed from the example of FIG. 8 without limitation and within the scope of the present invention, as claimed.

In another embodiment of the invention, the magnetic field strength of generators 104 and 114 of FIGS. 1A and 2A may be sufficiently high that magnetic saturation of respective pole pieces 102 and 112 can occur. This pole piece saturation may be eliminated using the alternative magnetic field generator 1004*a*, 1004*b*, 1004*c*, 1004*d* geometry with pole piece 1002 shown in FIGS. 10A and 10B for the beam transport structure, and the alternative magnetic field generators 1104*a*, 1104*b*, 1104*c*, and 1104*d* with pole piece 1112 shown in FIGS. 11A and 11B for the RF cavity structures (also known as pillbox structures).

Figure 10A:
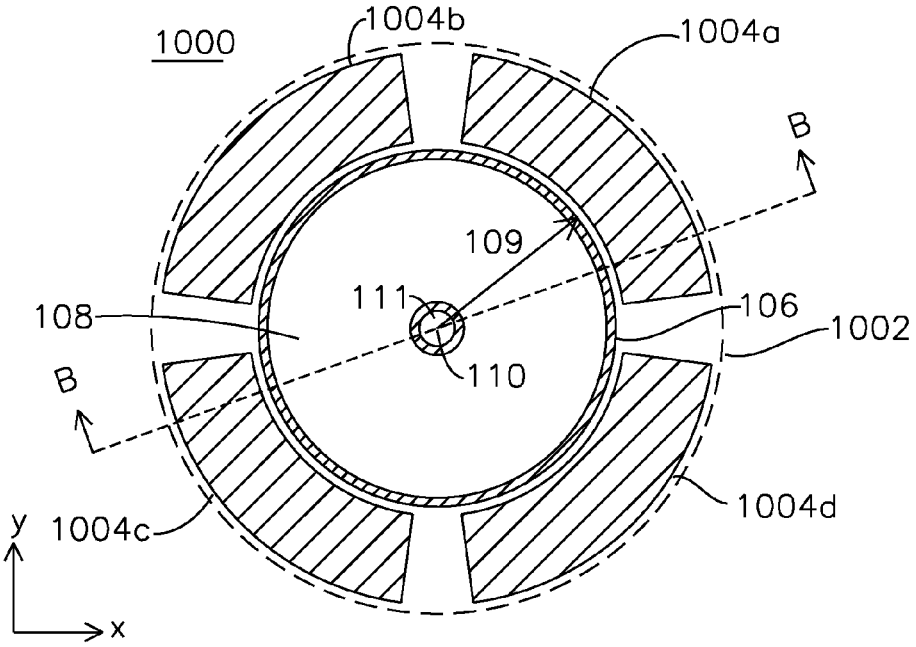
FIGS. 10A and 10B are composite cross section views of a beam transport structure according to another embodiment of the invention.
Figure 10B:
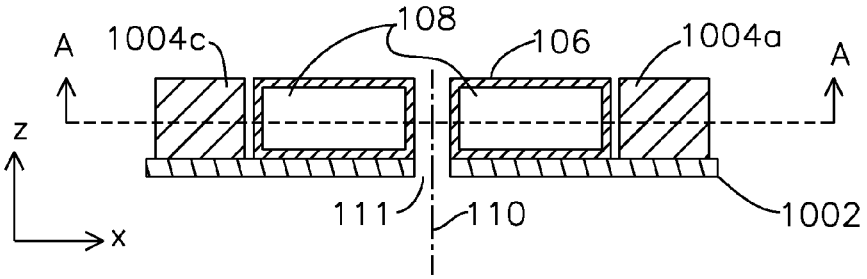

In the projected y-z plane view of the alternative beam transport structure 1000 shown in FIGS. 10A and 10B, magnetic field generators 1004*a*, 1004*b*, 1004*c*, 1004*d* have an inner radius about the z axis which is outside the radial extent 109 of the coolant chamber 108 and an outer radius which is within the radial extent of the pole piece 1002. The magnetic field generators 1004*a*, 1004*b*, 1004*c*, 1004*d*, have intervening gaps to allow coolant chamber 108 inlets and outlets for transport of coolant, and other structures as required which may be coupled to the structure forming the coolant chamber 108 formed by coolant walls 106, with other structures such as beam tunnel 100 and central axis 110 as were shown in FIG. 1. In one embodiment of the invention, the number of magnetic field generators is four, and each of the magnetic field generators has approximately 15 degree opening circumferential to the z axis (seen in FIG. 10A) to provide coolant inlets and outlets to chamber 108.

Figure 11A:
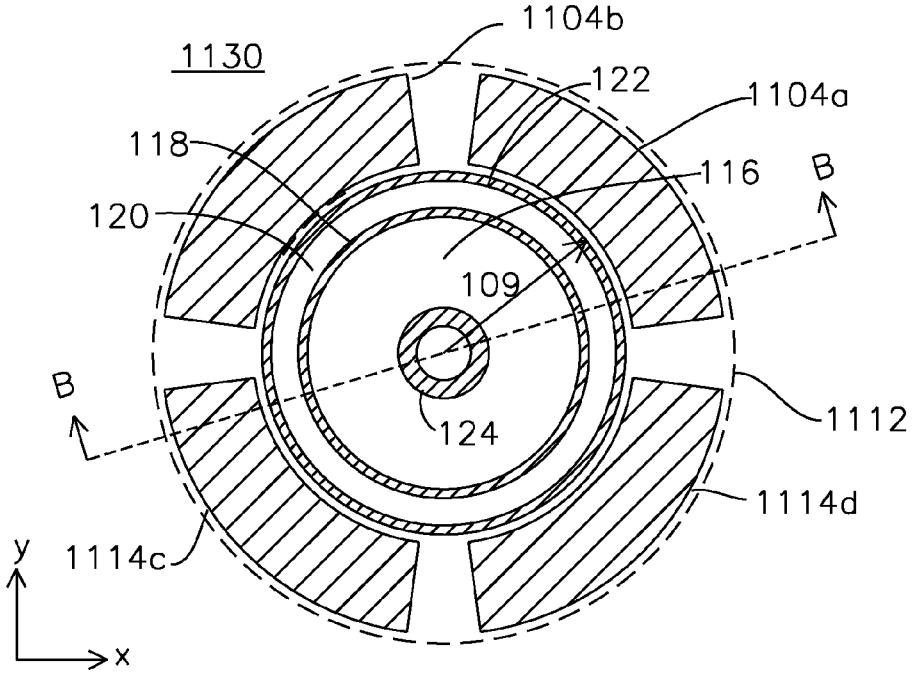
FIGS. 11A and 11B are composite cross section views of an RF cavity according to another embodiment of the invention.
Figure 11B:
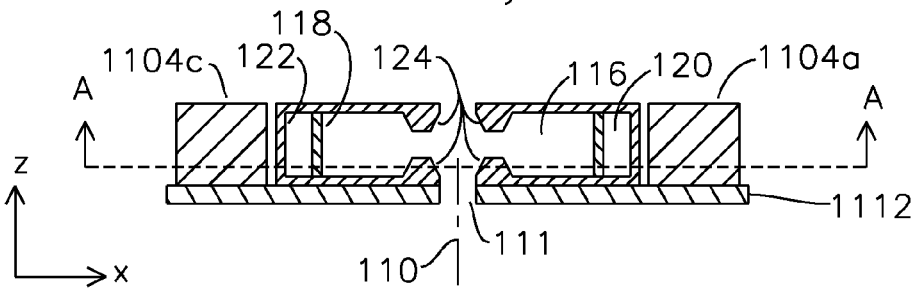

Similarly, FIGS. 11A and 11B show the RF cavity structure 1130, with similarly constructed magnetic field generators 1104*a*, 1104*b*, 1104*c*, and 1104*d*. The gaps between magnetic field generators in FIG. 11A may be used as in FIG. 2A for coolant inlets and outlets coupling to coolant chamber 120, RF input and output waveguides, tuning structures for allowing for tuning of the RF cavity 116, or other structures coupling to RF cavity 116, which has other structures 118, 122, and 124, as were previously described for FIGS. 2A and 2B. The magnetic field generators 1004*a*, 1004*b*, 1004*c*, 1004*d* of FIGS. 10A and 10B, and 1104*a*, 1104*b*, 1104*c*, and 1104*d* of FIGS. 11A and 11B perform the same function as the magnetic field generators 104*a*, 104*b*, 104*c*, and 104*d* of FIGS. 1A and 1B, and 114*a*, 114*b*, 114*c* and 114*d* of FIGS. 2A and 2B. For clarity, the magnetic field generators of FIGS. 1A, 1B, 2A and 2B may alternatively be referred to as "pill magnets" or "cylindrical magnetic field generators", being formed into cylindrical shape of height 105 shown in FIG. 1B, and magnetized to generate an axial magnetic field parallel to central axis 110. Similarly, the magnetic field generators shown in FIGS. 10A, 10B, 11A, and 11B may alternatively be referred to as "arc section magnetic field generators", having an inner radius, and outer radius, a height analogous to height 105 of FIG. 1B, cut into radial arc sections about central axis 110, and being magnetized to generate an axial magnetic field parallel to axis 110. The cylindrical magnetic field generator and arc section magnetic field generator are described in the associated figures for example illustration only, and are not intended to limit the magnetic field generators to only these types.

While the number of magnetic field generators positioned circumferentially about the z axis is shown in FIGS. 1A, 1B, 2A, 2B, 10A, 10B, 11A, and 11B as four, any larger or smaller number n of magnetic field generators may be used for the examples previously described, with the magnetic field generators preferably distributed uniformly about the central axis 110.

Figure 9:
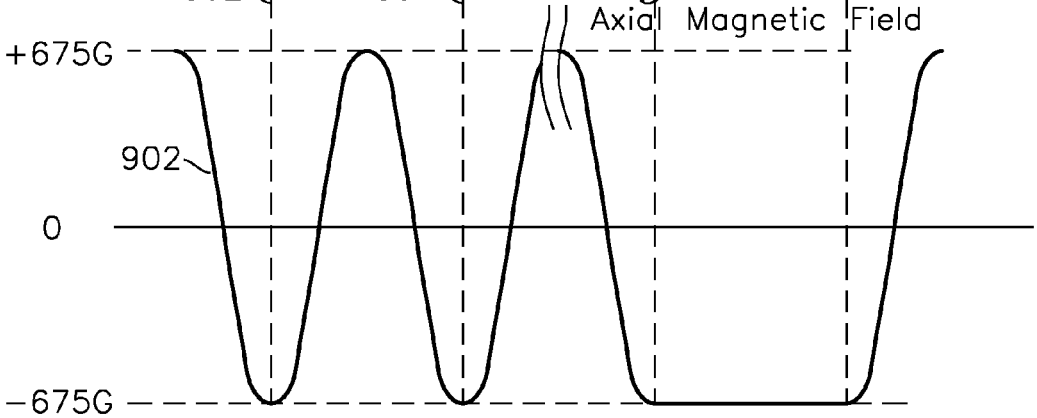
FIG. 9 is a plot of the axial magnetic field of the PPM klystron of FIG. 8.

Regardless of which embodiment of the RF cavity structure or beam transport cavity structure is used, in a preferred embodiment of the invention, the RF cavity structures, which have pre-determined axial locations determined by the initial klystron design, each RF cavity can have the same thickness as other RF cavities, and the beam transport structures which separate them (with any number of such beam transport structures placed between each RF cavity structures, which may also have the same thickness as other beam transport structures, such that a large number of common elements can be used in fabricating the RF cavity structures and beam tunnel structures for economy of construction. As was described for FIG. 8, the number of beam transport structures (with adjacent opposite magnetic field polarity) between RF cavity structures may vary from 0 to any number of intervening beam transport structures, as was previously described. In another embodiment of the invention, all of the RF cavity structures and beam transport structures have the same thickness, thereby providing economies of scale in manufacturing since all of the main components (magnetic field generators, coolant enclosure and RF cavities) have the same physical dimensions. As shown in the plot of FIG. 9, however constructed, the magnetic field generated by each successive structure (beam transport, RF cavity, or extended pole piece) will have an opposite magnetic polarity of an adjacent structure.

Figure 12A:
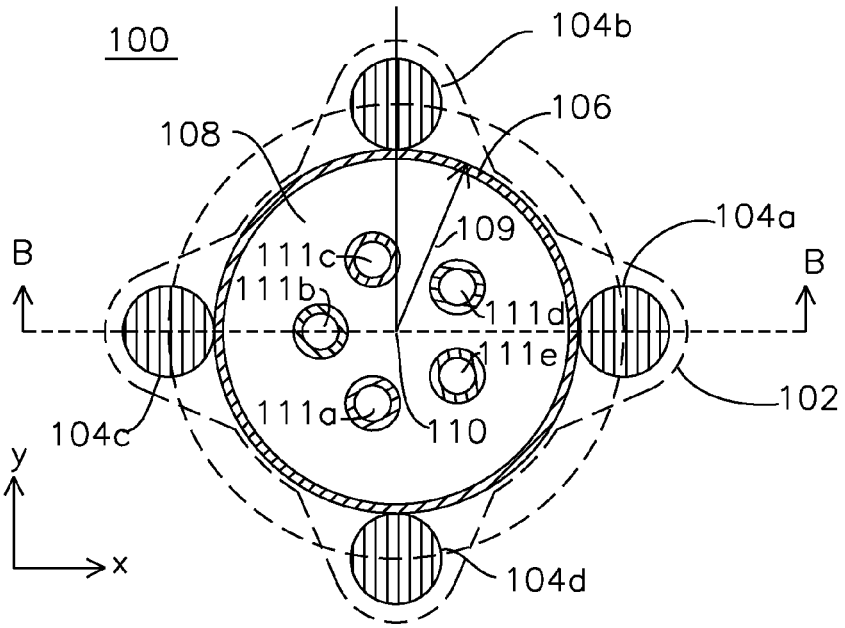
FIGS. 12A and 12B are composite cross section views of a multi-beam transport structure according to another embodiment of the invention.
Figure 12B:
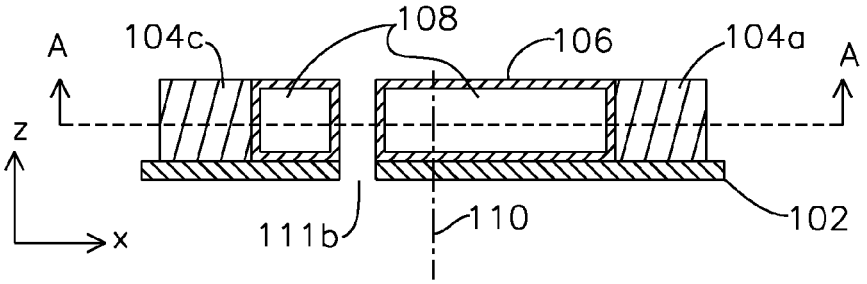
Figure 13A:
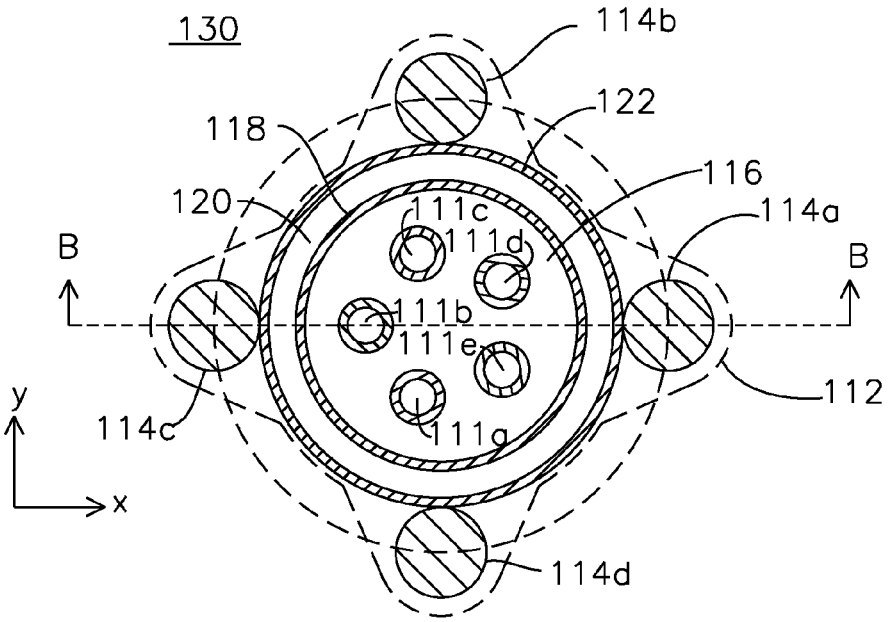
FIGS. 13A and 13B are composite cross section views of a multi-beam RF cavity according to another embodiment of the invention.
Figure 13B:
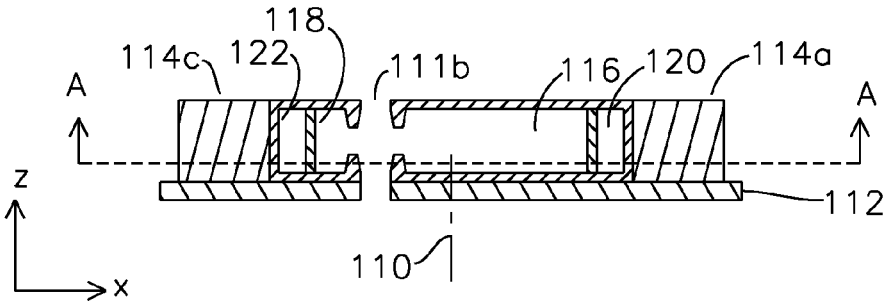

In another embodiment of the invention, instead of a single beam tunnel along the central axis 110, the inventors have discovered that the magnetic field generated by the RF cavity structures and the beam transport structures is sufficiently uniform to support multiple electron beams which may be used in a klystron of the present invention without divergence or electron beam deterioration. An example beam transport cavity for such use, which has been adapted from the beam transport structure of FIGS. 1A and 1B is shown in FIGS. 12A and 12B (which section B-B is shown through just one beam tunnel 111*b*, although all are identical), respectively, and an example RF cavity structure for multi-beam use adapted from FIGS. 2A and 2B is shown in FIGS. 13A and 13B. The structures of FIGS. 12A, 12B, 13A, and 13B are similar to those shown in FIGS. 1A, 1B, 2A, and 2B, respectively, with the substitution of individual beam tunnels 111*a*, 111*b*, 111*c*, 111*d*, and 111*e* for the single beam tunnel 111 previously described in FIGS. 1A, 1B, 2A, and 2B. Independently, any number of magnetic field generators 104*a-d*, 114*a-d*, 1004*a-d* and 1104*a-d* etc may be present, and any number of beam tunnels may be present. All other aspects of operation are similar to those previously described. Additionally, the multi-beam klystron may be adopted to use the beam transport structures of FIGS. 10A and 10B, as well as the RF cavity structures of FIGS. 11A and 11B.

For the described embodiments of the invention, the RF cavities are positioned with an axial (z axis) periodicity which is defined by the RF circuit design, typically a fixed number of radians apart, as is known in the art of klystron RF circuit design. The periodicity of the RF circuit components is modified as required for compatibility with the periodicity of the magnetic field, which takes precedence in the design of the PPM stack. The RF cavities are typically formed from a material which optimizes the resonant characteristics, such as stainless steel or copper, optionally coated with a surface coating such as kanthol or with iron filings which are bonded to the inner surface of the RF cavity to modify the Q of the RF cavity. The RF cavity gap reducing structures 124 of FIG. 2B may also have a shape or extent which optimizes the performance of the klystron. Some embodiments of the invention may require RF structure cooling, but do not require beam transport structure cooling such as chambers 108 of FIG. 1B, 10A, 10B, 12A, or 12B. In that example embodiment, the beam tunnel (for a single beam device) or beam tunnels (for a multi-beam device) would be present in the beam transport structure, but the coolant chamber 108 would not be present or necessary, but could remain for spacing purposes, for example. Other klystron devices with even lower power requirements many not require any cooling at all, for which the RF cavity coolant chambers 120 of FIGS. 2A, 2B, 11A, 11B, 13A, and 13B would also not be present.

Another embodiment of the invention may be drawn to a "sheet beam" gun, where the circular beam tunnel described herein is a square aperture or rectangular aperture for passage of a sheet electron beam.

Accordingly, the embodiments described herein are provided as example constructions, and may be practiced in any combination. For example, the cylindrical magnetic field generators may be replaced with arc section magnetic field generators for any of the described embodiments. The multi-beam structure of FIGS. 12A, 12B, 13A, and 13B may be practiced with any of the preceding single beam structures. The extended PPM stack of FIG. 8 may be practiced with any magnetic field generator type, or with a single or multiple beam tunnel device. The scope and breadth of the invention is described in the claims which follow.

We claim:

1. A periodic permanent magnet (PPM) klystron with a central axis and having:

a plurality of beam transport structures, each said beam transport structure comprising:
a ferrous pole piece;
a plurality of magnetic field generators positioned beyond a first radius from said central axis;
a beam transport section formed by the inner diameter of a cooling chamber which surrounds said beam tunnel, the cooling chamber outer diameter extending to within said first radius;
a plurality of RF cavity structures, each said RF cavity structure comprising:
a ferrous pole piece;
a plurality of magnetic field generators positioned a second radius from said central axis and adjacent to said ferrous pole piece;
a beam tunnel aperture formed by the inner diameter of an RF cavity, the beam tunnel aperture coupled to the RF cavity, the RF cavity extending to a third radius from said central axis;
a coolant chamber formed in the extent between said RF cavity and said magnetic field generators;
where the magnetic field generators of said beam transport structures and said RF cavity structures are placed in alternating magnetic field polarity, and said first said RF cavity coupled to an input source and a last said RF cavity structure coupled to an RF output.

2. The PPM klystron of claim 1 where said magnetic field generators are either cylindrical magnetic field generators or arc section magnetic field generators.

3. The PPM klystron of claim 1 where said plurality of magnetic field generators in said beam transport structures and said RF cavity structures is four.

4. The PPM klystron of claim 1 where said ferrous pole piece is radially elongate in the region of said magnetic field generators.

5. The PPM klystron of claim 1 where said RF cavities have an inner surface of at least one of: stainless steel, copper, bonded iron filings, or kanthol.

6. The PPM klystron of claim 1 where said beam transport coolant chambers and said RF cavity coolant chambers are coupled to a circulating coolant.

7. A periodic permanent magnet (PPM) klystron with a central axis and having:
a plurality of beam transport structures, each said beam transport structure comprising:
a ferrous pole piece;
a plurality of magnetic field generators positioned beyond a first radius from said central axis;
a beam transport section formed by the inner diameter of a cooling chamber which surrounds said beam tunnel, the cooling chamber outer diameter extending to within said first radius;
a plurality of RF cavity structures, each said RF cavity structure comprising:
a ferrous pole piece;
a plurality of magnetic field generators positioned a second radius from said central axis and adjacent to said ferrous pole piece;
a beam tunnel aperture formed by the inner diameter of an RF cavity, the beam tunnel aperture coupled to the RF cavity, the RF cavity extending to a third radius from said central axis;
a coolant chamber formed in the extent between said RF cavity and said magnetic field generators;
where the magnetic field generators of said beam transport structures and said RF cavity structures are placed in alternating magnetic field polarity;
an output RF cavity structure comprising:
a magnetic field generator spanning said output RF cavity structure;
a plurality of final beam transport structures and final RF cavity structures, each said final beam transport structure having a beam tunnel aperture formed by a coolant chamber circulating a coolant, each said final RF cavity structure having a beam tunnel aperture coupled to an RF cavity;
said output RF cavity structure having a final RF cavity coupled to an RF output port, said plurality of RF cavity structures having a first RF cavity coupled to an RF input port.

8. The PPM klystron of claim 7 where said magnetic field generators are either cylindrical magnetic field generators or arc section magnetic field generators.

9. The PPM klystron of claim 7 where said plurality of magnetic field generators in said beam transport structures and said RF cavity structures is four.

10. The PPM klystron of claim 7 where said ferrous pole piece is radially elongate in the region of said magnetic field generators.

11. The PPM klystron of claim 7 where said RF cavities have an inner surface of at least one of stainless steel, copper, bonded powdered iron, or kanthol.

12. The PPM klystron of claim 7 where said beam transport coolant chambers and said RF cavity coolant chambers are coupled to a circulating coolant.

13. The PPM klystron of claim 7 where said beam tunnel is symmetric about said central axis and said beam transport structures and said RF cavity structures have a substantially constant diameter.

14. The PPM klystron of claim 13 where said beam tunnel of said output RF cavity structure has a greater beam tunnel diameter than preceding said beam transport structure beam tunnel and preceding said RF cavity structures.

15. A multi-beam periodic permanent magnet (PPM) klystron having a central axis surrounded by a plurality of parallel beam tunnels, the multi-beam PPM klystron having:
a plurality of beam transport structures, each said beam transport structure comprising:
a ferrous pole piece;
a plurality of magnetic field generators positioned beyond a first radius from said central axis;
a beam transport section formed by a cooling chamber which surrounds said central axis and includes a passageway for each said beam tunnel, the cooling chamber outer diameter extending to within said first radius;
a plurality of RF cavity structures, each said RF cavity structure comprising:
a ferrous pole piece;
a plurality of magnetic field generators positioned a second radius from said central axis and adjacent to said ferrous pole piece;
An RF cavity having a plurality of apertures, one said aperture for each said beam tunnel, each beam tunnel thereby coupled to the RF cavity, the RF cavity extending to a third radius from said central axis;
a coolant chamber formed in the extent between said RF cavity and said magnetic field generators;
where the magnetic field generators of said beam transport structures and said RF cavity structures are placed in alternating magnetic field polarity, and said first said RF cavity coupled to an input source and a last said RF cavity structure coupled to an RF output.

16. The multi-beam PPM klystron of claim 15 where said beam tunnels are arranged a fixed radial distance from said central axis.

17. The multi-beam PPM klystron of claim 15 where at least one said RF cavity inner surface is formed from at least one of: stainless steel, copper, bonded powdered iron, or kanthol.

18. The multi-beam PPM klystron of claim 15 where at least one said RF cavity includes a tuning structure.

19. The multi-beam PPM klystron of claim 15 where said magnetic field generators are either cylindrical magnetic field generators or arc section magnetic field generators.

20. A multi-beam periodic permanent magnet (PPM) klystron having a central axis surrounded by a plurality of parallel beam tunnels, the multi-beam PPM klystron having:

a plurality of beam transport structures, each said beam transport structure comprising:

a ferrous pole piece;

a plurality of magnetic field generators positioned beyond a first radius from said central axis;

a beam transport section formed by a cooling chamber which surrounds said central axis and includes a passageway for each said beam tunnel, the cooling chamber outer diameter extending to within said first radius;

a plurality of RF cavity structures, each said RF cavity structure comprising:

a ferrous pole piece;

a plurality of magnetic field generators positioned a second radius from said central axis and adjacent to said ferrous pole piece;

an RF cavity having a plurality of apertures, one said aperture for each said beam tunnel, each beam tunnel thereby coupled to the RF cavity, the RF cavity extending to a third radius from said central axis;

a coolant chamber formed in the extent between said RF cavity and said magnetic field generators;

a final output structure;

where the magnetic field generators of said beam transport structures and said RF cavity structures are placed in alternating magnetic field polarity, and said first said RF cavity coupled to an input source and a last said RF cavity structure coupled to an RF output and where said final output structure comprises:

a magnetic field generator spanning said final output structure;

a plurality of final beam transport structures and final RF cavity structures, each said final beam transport structure having a passageway for each said beam tunnel, each said final beam transport structure forming a a closed coolant chamber for circulating a coolant, each said final RF cavity structure having a plurality of beam tunnel apertures coupled to an RF cavity, each said beam tunnel aperture corresponding to a particular beam tunnel;

said final output structure having a final RF cavity coupled to an RF output port;

said plurality of RF cavity structures also having a first RF cavity coupled to an RF input port.

* * * * *